US005193692A

United States Patent [19]

Farley et al.

[11] Patent Number: 5,193,692

[45] Date of Patent: Mar. 16, 1993

[54] RECYCLABLE DUNNAGE SUPPORT ASSEMBLY

[76] Inventors: Charles Farley, 3380 Breezewood Trail, Ortonville, Mich. 48462; Lawrence E. Plawecki, 13735 Neal, Davisburg, Mich. 48350

[21] Appl. No.: 867,365

[22] Filed: Apr. 13, 1992

[51] Int. Cl.[5] ..... A47F 7/00

[52] U.S. Cl. ..... 211/41; 211/40

[58] Field of Search ..... 211/40, 41; 410/34, 410/35; 206/448

[56] References Cited

U.S. PATENT DOCUMENTS

| | | | |
|---|---|---|---|
| 3,734,315 | 5/1973 | James | 211/192 |
| 3,857,494 | 12/1974 | Giardini | 211/194 |
| 4,467,922 | 8/1984 | Rowley | 211/13 |
| 4,489,835 | 12/1984 | Tombol et al. | 211/41 |
| 4,899,880 | 2/1990 | Carter | 211/41 X |
| 4,919,277 | 4/1990 | Jeruzal | 211/41 |

*Primary Examiner*—David M. Purol
*Assistant Examiner*—Sarah A. Lechok
*Attorney, Agent, or Firm*—Gifford, Groh, Sprinkle, Patmore and Anderson

[57] ABSTRACT

The present invention relates to a recyclable dunnage support assembly. The dunnage support assembly includes a dunnage support member which is secured to a frame. The dunnage support member includes at least one surface which is adapted to engage and support dunnage for shipment. Each dunnage support member, furthermore, is formed from pulverized automative tire fragments which are held together by a binder. When use of the dunnage support is no longer necessary, the dunnage support member can be repulverized into fragments which are then reconstituted together with a binder to form a new and different dunnage support assembly. As such, the dunnage support member is recyclable virtually indefinitely.

6 Claims, 1 Drawing Sheet

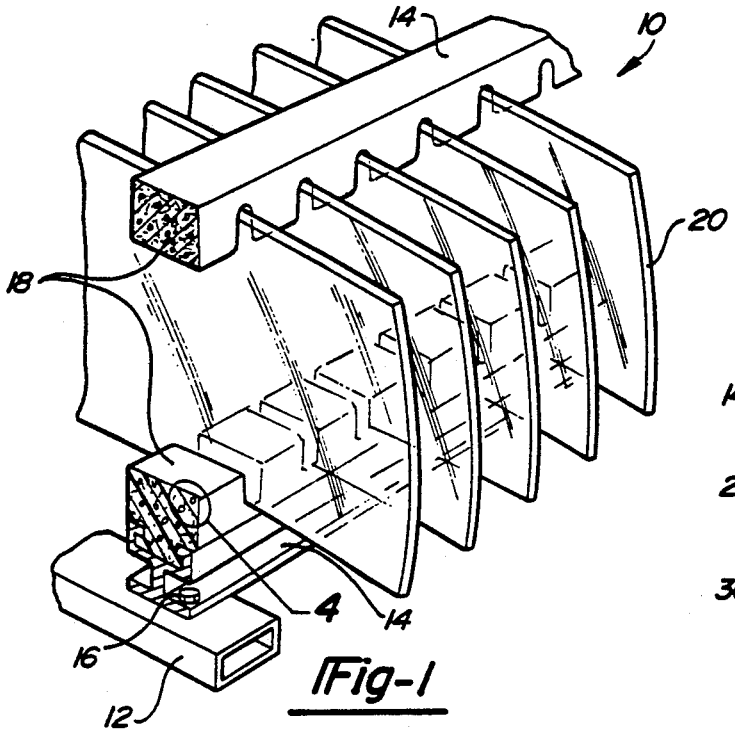
Fig-1
Fig-2
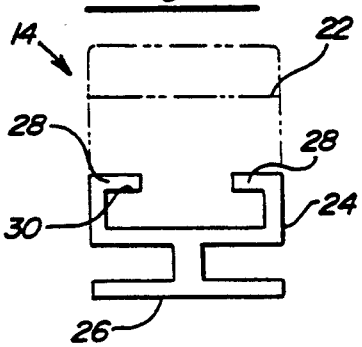
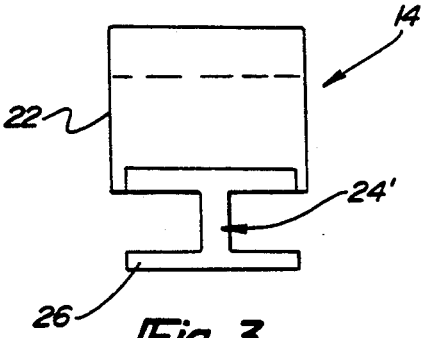
Fig-3
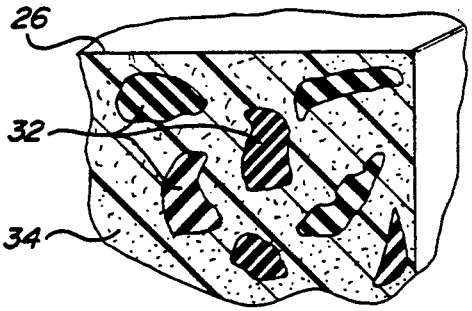
Fig-4
Fig-5
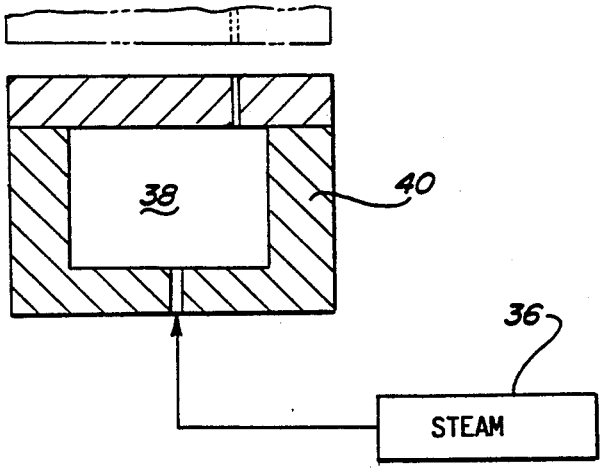

RECYCLABLE DUNNAGE SUPPORT ASSEMBLY

BACKGROUND OF THE INVENTION

I. Field of the Invention

The present invention relates generally to dunnage support assemblies and, more particularly, to a recyclable dunnage support assembly.

II. Description of the Prior Art

Dunnage support assemblies are frequently employed for transporting industrial articles from one location to another. These previously known dunnage support assemblies typically comprise a dunnage support member which is secured to a rigid frame. The dunnage support member, itself, is formed of an elastomeric material and has a surface which is adapted to engage and support the dunnage for transportation. The elasticity of the dunnage support member, of course, protects the dunnage from damage which might otherwise result from jarring and vibration of the dunnage during transport.

Typically, these elastomeric dunnage support members are formed from polyisocyanate which reacts with a resin. The reaction itself is carried out within a mold so that the mold, which conforms in shape to the dunnage support member, forms the part in the desired final shape. Such dunnage support members, furthermore, are custom fabricated for the particular dunnage to be transported.

The disposal of these previously known dunnage support member after their useful life, however, has presented a problem. The elastomeric material formed by the reaction of polyisocyanate and resin cannot be recycled and, instead, must be disposed of in a landfill or the equivalent. Such disposal is not only expensive, but also presents potential hazards to the environment.

SUMMARY OF THE PRESENT INVENTION

The present invention provides a dunnage support assembly which overcomes the disadvantages of the previously known dunnage support assemblies.

In brief, the dunnage support assembly of the present invention comprises a dunnage support member which, in turn, is secured to a frame. The dunnage support member is constructed of an elastomeric material having one surface which is adapted to engage and support the dunnage.

Unlike the previously known dunnage support assemblies, however, the dunnage support member of the present invention is formed from pulverized automotive tires which are held together by a binder. Either polyisocyanate or an organic salt can be used as a binder to hold the pulverized tire fragments together.

At the end of the useful life of the dunnage support members, the dunnage support members are repulverized, intermixed with binder and used to form new dunnage support members. As such, the dunnage support members of the present invention can be recycled virtually indefinitely.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIG. 1 is a perspective view illustrating a preferred embodiment of the present invention;

FIG. 2 is an end view of a preferred embodiment of the present invention;

FIG. 3 is an end view similar to FIG. 2, but illustrating a modification thereof;

FIG. 4 is a view taken of circle 4 in FIG. 1 and enlarged for clarity; and

FIG. 5 is a diagrammatic view illustrating the method of the present invention.

DETAILED DESCRIPTION OF PREFERRED EMBODIMENTS OF THE PRESENT INVENTION

With reference first to FIG. 1, a dunnage support assembly 10 of the present invention is thereshown. The dunnage support assembly 10 includes a frame 12 which is typically constructed of a rigid material, such as tubular steel. Such frames 12 are often used, sometimes with structural modifications, on different dunnage support assemblies.

At least one, and oftentimes more, dunnage support members 14 are secured to the frame 12 by any conventional means, such as fasteners 16. Each dunnage support member 14 includes at least one surface 18 which is adapted to engage and support dunnage 20 to the frame 12. For example, as shown in FIG. 1, the dunnage 20 comprises a plurality of glass panes. These glass panes are received within slots formed on the surface 18 of the dunnage support members 14 so that the glass panes are entrapped between the two dunnage support members 14.

With reference now to FIGS. 1 and 2, the dunnage support member 14 includes an elastomeric portion 22 which is attached to the frame 12 by a rigid retainer 24 having a lower T-shaped portion 26. The retainer 24 is typically constructed of metal and is attached to the elastomeric portion 22 by flanges 28 which are received within recesses 30 formed along the sides of the elastomeric portion 22 of the dunnage support member 14.

As best shown in FIG. 3, a modified retainer 24' can be molded into the elastomeric portion 22 during the manufacturing process. The retainer 24', like the retainer 24 in FIG. 2, includes a lower T-shaped portion 26 which is attached to the frame 12.

With reference now to FIG. 4, unlike the previously known dunnage support members, the elastomeric portion 22 of the dunnage support member 14 of the present invention is formed from pulverized fragments 32 of automotive tires. These fragments 32 are bound together by a binder 34 so that the resulting elastomeric portion 26 has sufficient resiliency to protect the dunnage 20 from shocks and vibration during transportation.

Different sorts of binders 34 can be used to bind the tire fragments together. For example, an organic salt can be used to bind the tire fragments 32 together. In forming the dunnage support member, the tire fragments and binder are placed in a mold conforming in shape to the dunnage support member and the binder is allowed to set.

Alternatively, polyisocyanate can be used to bind the tire fragments 32 together. As shown in FIG. 5, when polyisocyanate is used to bind the tire fragments 32 together, the tire fragments and binder, i.e. polyisocyanate, are placed in a mold chamber 38 of a mold 40. The mold chamber 38 conforms in shape to the desired dunnage support member. Steam from a steam source 36 is then pumped through the mold chamber 38. The introduction of steam into the mold chamber 38 during the formation of the dunnage support member 10 using polyisocyanate as a binder accelerates the setting time of the polyisocyanate and, accordingly, reduces manufacturing time and costs.

A primary advantage of the dunnage support members of the present invention is that, when the dunnage support members are no longer needed, the elastomeric portion 22 of the dunnage support members 14 is simply regrounded or repulverized into tire fragments 32 with some binder 34 included. This pulverized material can then be used to form new dunnage support members by remolding the pulverized material with a binder in the desired mold in the fashion previously described. In this fashion, the material from the dunnage support members 14 can be virtually continuously recycled and reused.

From the foregoing, it can be seen that the present invention provides a simple and yet highly effective recyclable dunnage support member as well as a method for constructing the dunnage support. Having described my invention, however, many modifications thereto will become apparent to those skilled in the art to which it pertains without deviation from the spirit of the invention as defined by the scope of the appended claims.

We claim:

1. A recyclable dunnage support assembly comprising:

a frame, a dunnage support member, means for securing said frame to said dunnage support member, wherein said dunnage support member includes at least one surface which is adapted to engage and support dunnage, wherein said dunnage support member is formed from pulverized tire fragments held together by a binder.

2. The invention as defined in claim 1 wherein said binder is polyisocyanate.

3. The invention as defined in claim 1 wherein said binder is an organic salt.

4. A method for manufacturing a dunnage support member comprising the steps of forming a mold having a mold chamber with a shape conforming to the dunnage support member, filling said mold chamber with pulverized fragments of tires and a binder, allowing said binder to set and bond said pulverized fragments of tires together.

5. The invention as defined in claim 4 wherein said binder comprises polyisocyanate and further comprising the step of passing steam through said mold chamber while said binder is setting.

6. The invention as defined in claim 4 wherein said binder comprises an organic salt.

* * * * *